US009184515B1

(12) United States Patent
Freakes

(10) Patent No.: US 9,184,515 B1
(45) Date of Patent: Nov. 10, 2015

(54) TERMINAL BLOCKS FOR PRINTED CIRCUIT BOARDS

(71) Applicant: Anthony Freakes, Lawrenceville, NJ (US)

(72) Inventor: Anthony Freakes, Lawrenceville, NJ (US)

( * ) Notice: Subject to any disclaimer, the term of this patent is extended or adjusted under 35 U.S.C. 154(b) by 24 days.

(21) Appl. No.: 14/039,636

(22) Filed: Sep. 27, 2013

Related U.S. Application Data

(60) Provisional application No. 61/707,493, filed on Sep. 28, 2012, provisional application No. 61/709,479, filed on Oct. 4, 2012.

(51) Int. Cl.
*H01R 4/28* (2006.01)

(52) U.S. Cl.
CPC ..... *H01R 4/28* (2013.01)

(58) Field of Classification Search
CPC ..... H01R 4/2433
USPC ..... 439/409, 417
See application file for complete search history.

(56) References Cited

U.S. PATENT DOCUMENTS 3,985,416 A * 10/1976 Dola et al. ..... 439/403
3,992,072 A * 11/1976 Anhalt et al. ..... 439/404
4,040,701 A * 8/1977 Gressitt ..... 439/405
4,340,270 A * 7/1982 Wilmes et al. ..... 439/397
4,426,125 A * 1/1984 Crawford ..... 439/404
4,431,247 A * 2/1984 Abdullah et al. ..... 439/392
4,486,064 A * 12/1984 Long et al. ..... 439/402
4,496,206 A * 1/1985 Markwardt et al. ..... 439/409
4,652,070 A * 3/1987 Suffi ..... 439/404
4,668,039 A * 5/1987 Marzili ..... 439/404
4,684,195 A * 8/1987 Anderson et al. ..... 439/404
4,697,862 A * 10/1987 Hasircoglu ..... 439/404
4,701,138 A * 10/1987 Key ..... 439/417
4,764,125 A * 8/1988 Debortoli ..... 439/403
4,826,449 A * 5/1989 Debortoli et al. ..... 439/411
4,938,711 A * 7/1990 Davis et al. ..... 439/405
4,978,314 A * 12/1990 Maejima ..... 439/398
4,993,966 A * 2/1991 Levy ..... 439/411
5,064,383 A * 11/1991 Locati et al. ..... 439/405
5,096,437 A * 3/1992 Levy ..... 439/411
5,163,855 A * 11/1992 Gerke et al. ..... 439/709
5,240,432 A * 8/1993 Daoud ..... 439/417
5,399,099 A * 3/1995 English et al. ..... 439/417
5,423,694 A * 6/1995 Jensen et al. ..... 439/417
5,449,299 A * 9/1995 Shimirak et al. ..... 439/417
5,451,170 A * 9/1995 Suffi ..... 439/404
5,549,484 A * 8/1996 Chen ..... 439/417
RE35,325 E * 9/1996 Wass et al. ..... 439/412
5,551,889 A * 9/1996 Kozel et al. ..... 439/404
5,588,869 A * 12/1996 Jensen et al. ..... 439/417
5,597,321 A * 1/1997 Jacques ..... 439/417
RE35,476 E * 3/1997 Levy ..... 439/411
5,620,332 A * 4/1997 Gerke et al. ..... 439/417

(Continued)

*Primary Examiner* — Ross Gushi
(74) *Attorney, Agent, or Firm* — Timothy X. Gibson, Esq.; Gibson & Dernier LLP

(57) ABSTRACT

A screwless terminal block and insulation displacement connector device includes a housing and slide slidably engaged in the housing, the device operable to receive a lead wire having lead wire conductors and an insulation layer, and to further receive a conductive connector. Movement of the slide to a closed position with a lead wire inserted in the device causes the lead wire to contact sharp connector edges, which, with continued downward force, cut the insulation layer. Continued downward force, to full closure of the device, forces lead wire conductors into compressed multiple electrical contact with the connector.

9 Claims, 10 Drawing Sheets

(56) References Cited

U.S. PATENT DOCUMENTS

| | | | | | |
|---|---|---|---|---|---|
| 5,622,517 | A * | 4/1997 | Heng et al. | 439/417 |
| 5,641,302 | A * | 6/1997 | Adams | 439/417 |
| 5,667,402 | A * | 9/1997 | Denovich et al. | 439/409 |
| 5,759,065 | A * | 6/1998 | Hatagishi et al. | 439/596 |
| 5,785,548 | A * | 7/1998 | Capper et al. | 439/409 |
| 5,860,829 | A * | 1/1999 | Hower et al. | 439/417 |
| 5,989,057 | A * | 11/1999 | Gerke et al. | 439/417 |
| 6,015,312 | A * | 1/2000 | Escane | 439/417 |
| 6,027,362 | A * | 2/2000 | LaCroix | 439/404 |
| 6,050,845 | A * | 4/2000 | Smalley et al. | 439/417 |
| 6,086,407 | A * | 7/2000 | Daoud | 439/405 |
| 6,120,315 | A * | 9/2000 | Gaertner et al. | 439/395 |
| 6,135,804 | A * | 10/2000 | Lux | 439/397 |
| 6,135,827 | A * | 10/2000 | Okabe et al. | 439/731 |
| 6,139,353 | A * | 10/2000 | Muz | 439/417 |
| 6,152,760 | A * | 11/2000 | Reeser | 439/409 |
| 6,247,960 | B1 * | 6/2001 | Daoud | 439/417 |
| 6,254,421 | B1 * | 7/2001 | Denovich et al. | 439/409 |
| 6,299,475 | B1 * | 10/2001 | Huspeni et al. | 439/412 |
| 6,302,723 | B1 * | 10/2001 | Baum et al. | 439/412 |
| 6,302,725 | B1 * | 10/2001 | Daoud | 439/482 |
| 6,312,288 | B1 * | 11/2001 | Genz et al. | 439/628 |
| 6,315,595 | B1 * | 11/2001 | LaPorte et al. | 439/412 |
| 6,328,592 | B1 * | 12/2001 | Burke et al. | 439/417 |
| 6,406,324 | B1 * | 6/2002 | Duesterhoeft et al. | 439/409 |
| 6,457,990 | B1 * | 10/2002 | Daoud | 439/409 |
| 6,488,539 | B1 * | 12/2002 | Turek et al. | 439/620.21 |
| 6,500,020 | B2 * | 12/2002 | Vo et al. | 439/409 |
| 6,579,115 | B2 * | 6/2003 | Mitsugi | 439/417 |
| 6,672,893 | B1 * | 1/2004 | Sedlecky et al. | 439/417 |
| 6,716,054 | B1 * | 4/2004 | Denovich et al. | 439/404 |
| 6,796,830 | B2 * | 9/2004 | Suss et al. | 439/409 |
| 6,875,043 | B2 * | 4/2005 | Turek et al. | 439/397 |
| 6,881,091 | B2 * | 4/2005 | Brandl et al. | 439/417 |
| 7,056,147 | B2 * | 6/2006 | Arias et al. | 439/417 |
| 7,063,557 | B2 * | 6/2006 | Ziemke et al. | 439/417 |
| 7,121,871 | B2 * | 10/2006 | Duesterhoeft et al. | 439/417 |
| 7,195,513 | B1 * | 3/2007 | Gherardini et al. | 439/401 |
| 7,201,601 | B2 * | 4/2007 | Lappohn | 439/404 |
| 7,270,564 | B1 * | 9/2007 | Boischio | 439/417 |
| 7,320,616 | B1 * | 1/2008 | Legrady et al. | 439/404 |
| 7,354,295 | B2 * | 4/2008 | Tashiro et al. | 439/397 |
| 7,399,197 | B2 * | 7/2008 | Fasce et al. | 439/392 |
| 7,435,128 | B2 * | 10/2008 | Powell et al. | 439/403 |
| 7,458,840 | B2 * | 12/2008 | Pratt | 439/409 |
| 7,465,184 | B2 * | 12/2008 | Scherer et al. | 439/408 |
| 7,481,666 | B2 * | 1/2009 | Stein | 439/409 |
| 7,503,797 | B2 * | 3/2009 | Lappoehn | 439/404 |
| 7,527,517 | B2 * | 5/2009 | Tashiro et al. | 439/397 |
| 7,530,827 | B2 * | 5/2009 | Caveney et al. | 439/211 |
| 7,540,759 | B2 * | 6/2009 | Liu et al. | 439/409 |
| 7,549,891 | B2 * | 6/2009 | Mossner et al. | 439/404 |
| 7,695,307 | B2 * | 4/2010 | Mossner et al. | 439/404 |
| 7,731,521 | B2 * | 6/2010 | Corradi et al. | 439/417 |
| 7,794,267 | B2 * | 9/2010 | Daily | 439/409 |
| 7,845,968 | B1 * | 12/2010 | Huss et al. | 439/409 |
| 7,901,231 | B2 * | 3/2011 | Hwang | 439/235 |
| 7,942,689 | B1 * | 5/2011 | Huss et al. | 439/409 |
| 7,976,334 | B2 * | 7/2011 | Bishop | 439/404 |
| 7,985,094 | B2 * | 7/2011 | Dennes et al. | 439/409 |
| 8,007,310 | B2 * | 8/2011 | Landis et al. | 439/404 |
| 8,109,783 | B2 * | 2/2012 | Bishop et al. | 439/404 |
| 8,192,223 | B2 * | 6/2012 | Bishop | 439/404 |
| 8,262,405 | B1 * | 9/2012 | Bishop | 439/439 |
| 8,267,715 | B2 * | 9/2012 | Roosdorp et al. | 439/404 |
| 8,568,157 | B2 * | 10/2013 | Bishop | 439/389 |
| 8,636,537 | B2 * | 1/2014 | Kettern et al. | 439/389 |
| 8,684,761 | B2 * | 4/2014 | Weaver et al. | 439/404 |
| 8,714,996 | B2 * | 5/2014 | Bishop | 439/404 |
| 8,740,638 | B2 * | 6/2014 | Lappoehn | 439/397 |
| 8,758,041 | B2 * | 6/2014 | Bishop et al. | 439/404 |
| 8,851,919 | B2 * | 10/2014 | Schutz | 439/405 |
| 8,900,005 | B2 * | 12/2014 | Taylor | 439/418 |
| 2003/0054685 | A1 * | 3/2003 | Shan | 439/402 |
| 2003/0171023 | A1 * | 9/2003 | Turek et al. | 439/395 |
| 2004/0248456 | A1 * | 12/2004 | Tashiro et al. | 439/405 |
| 2005/0227529 | A1 * | 10/2005 | Mrakovich et al. | 439/402 |
| 2006/0134966 | A1 * | 6/2006 | Lappohn | 439/404 |
| 2006/0160403 | A1 * | 7/2006 | Duesterhoeft et al. | 439/404 |
| 2012/0322294 | A1 * | 12/2012 | Lappoehn | 439/397 |

* cited by examiner

TERMINAL BLOCKS FOR PRINTED CIRCUIT BOARDS

CROSS-REFERENCE TO RELATED APPLICATIONS

This application claims the benefit of U.S. Provisional Patent Application Ser. Nos. 61/707,493 filed Sep. 28, 2012 and 61/709,479 filed Oct. 4, 2012, the entireties of which are incorporated by reference herein.

FIELD OF THE INVENTION

The invention relates to the field of terminal blocks for printed circuit boards.

BACKGROUND OF THE INVENTION

The terminal block is multi-purposed. A common purpose is to provide connecting points for a user of the parent device to make wire path connections from the power source to the controller and then on to any remote application of the power. Another purpose is to provide such possibilities of branching in the factory assembly of self-contained electrically powered and controlled units.

At the printed circuit board (PCB), probes from special connectors (one for each lead wire), penetrate through holes in the PCB and are soldered in the well-known (wave soldering) manner, at the opposite side of the PCB.

Prior art terminal block typically employ connectors which have screws and clamping washers. When making a connection, it is necessary to strip the insulation from the lead wire conductors, then if working with wires 20 AWG and above, bend the conductors into a hook, unscrew the terminating screw, feed the lead wire conductors into the space where it will be clamped, adjust the conductors to fit snugly around the body of the screw, tighten the screw until good retaining contact is made. When working with smaller insulated lead wires, the prior art terminal blocks typically employ a screw to press a metal edge into the stripped conductors of the lead wire. Some use only a screw.

Operators tend to overstrip insulation from wires so that there is sufficient exposed wire to make a screw-type connection to a terminal block. Exposed wires are subject to corrosion, especially in humid climates, coastal regions which have salt air and in environments where there is moisture.

Another drawback of terminal blocks with screw-type connectors is that in geographic regions that have wide temperature variations, such as in the northeastern United States, the temperature variations cause expansion and contraction of terminal blocks so that the screws become loose over time, destroying the connection to the lead wires.

Terminal blocks currently available feature terminals rigidly supported in the terminal block, which provides little allowance for movement of the terminal probe relative to the terminal block. The rigidity provides the advantage that the pitch between the terminal probes is accurate and immediately fits the (PCB) holes, and is usually UL recognized. A major disadvantage of this design is that the rigidity makes a condition where any vibration, such as from power screwdrivers, or any other maltreatment can damage the solder connections. Even if just one connection is damaged, the whole assembly of the PCB is destroyed. The design is also costly to manufacture.

Terminal blocks having screw type terminals to permit field connections to a PCB are subject to abusive forces directed at the relatively delicate construction of a PCB. The existence of power impact screwdrivers immediately allows the possibility of applying the wrong size tool to the job. Field operators may be apt to use whatever tool is at their disposal, and if that tool is a 12 volt cordless impact wrench, it is going to apply its impacts to the terminal screws, with damaging results. The following is a non-exhaustive list of negative results that may be expected from such treatment. The screw threads will be stripped. Many terminals only have formed and threaded internal threads, with not enough material to withstand impact type screw driving. The small Phillips recess is not strong enough to withstand the impacts and soon wears into a smooth cone. The impact wrench's violent seating causes the driving bit to jump out of the recess and damage the PCB. The impact wrench's violent bit jumping will break the important terminal block shields separating the terminal positions. The vibration causes the solder joints between the terminals and the PCB to fracture and lose reliable connection. The vibration causes the solder joints PCB conductor traces to lift from the substrate. Any accidental knock which hits the terminal block will break the solder joints and the block.

SUMMARY OF THE INVENTION

Accordingly, the presently disclosed subject matter provides in at least one embodiment terminal blocks that do not require pre-stripping of insulation from lead wires, so that the lead wire(s) can be used "as-is", preferably with a square or clean cut end. Because no insulation needs to be stripped from lead wires used in connection with the disclosed terminal blocks, problems arising from wire corrosion are minimized. Moreover, expansion or contraction of the disclosed terminal blocks due to changes in temperature do not affect the "screw-less" connection of the lead wire.

In accordance with further embodiments, terminal block connectors are provided which do not require a screw and/or washer to make the connection with the lead wire. In still further embodiments, terminal blocks are provided which are not subject to, or are at least resistant to, negative impacts from making connection to the lead wire.

In an embodiment non-screw terminal blocks are disclosed. "Screw-less" embodiments have the advantage of eliminating the screw, and its captive washer, a considerable immediate cost saving, and a complete elimination of the cost of PCB damage caused by dealing with the screw.

In one embodiment a non-screw terminal block may include guarded terminal positions for attaching lead wires and jumpers, as known in the art, but does not employ screws.

In another embodiment a non-screw terminal block is disclosed which includes quick-disconnect receiving connectors. The lead wires and jumpers may include an appropriate terminal applied to their ends.

In another embodiment a non-screw terminal block is disclosed having connectors which allow wire ends to be easily inserted and a simple device which permits a connecting blade to securely clamp the wire. In one embodiment a terminal block is provided which includes an aperture for receiving a tool such as a pin to disconnect the wire from the terminal block.

In one embodiment a non-screw terminal block is disclosed which permit fast, reliable connections by an installer. All the installer has to do is to cut the lead wire end off square, insert the wire into the wire slot and press the built in lever. The connection can be achieved in five seconds or less. No tools are required and no vibration is occurring. This means that when employing this terminal block, there is no need for techniques and/or structures for defeating vibration-induced effects.

In accordance with one embodiment, terminal blocks are provided whereby a lead wire may be inserted into a receiving space and a slide engages the wire and when a force is applied, approximately perpendicular to the lead wire longitudinal axis, the lead wire is moved and impinges against cutting edges of the connector. These cutting edges penetrate the lead wire insulation to allow the surface of the connector to make contact with the lead wire conductors. Further forced movement creates a contacting pressure between the lead wire conductors and the connector, locks the insulation to prevent the lead wire removal, and establishing a very firm and secure connection with the PCB circuit.

In accordance with an embodiment, a screwless terminal block and insulation displacement connector device for a printed circuit board (PCB) includes a housing having a channel and a slide slidably engaged in the channel, the slide operable to move in the channel, the housing including a first opening formed in a first side thereof configured to receive a lead wire and a second opening formed in a second side thereof configured to receive a conductive connector extending from a PCB, the slide including a lead wire guide configured to be aligned with the opening formed in the first side of the housing, the slide further including a connector slot configured to receive a conductive connector receivable in the second opening of the housing, wherein the conductive connector includes a lead wire receiving opening configured to be aligned with the lead wire guide and the first opening of the housing, wherein movement of the slide from a position distal the PCB toward the PCB is operable to move a lead wire positioned in the lead wire guide and the lead wire receiving opening of the conductive connector toward the PCB to form an electrical connection between the lead wire and the conductive connector. The slide may be reciprocally movable in the channel. In one embodiment the lead wire guide is configured to be substantially axially aligned with the opening formed in the first side of the housing and the conductive connector lead wire receiving opening, "substantially axially aligned" meaning that the alignment of the openings of the elements is adequate for a lead wire to be inserted through each of the opening formed in the first side of the housing, the lead wire guide and the conductive connector lead wire receiving opening such that when the slide is moved to a closed position an electrical connection is established between the lead wire and conductive connector.

In accordance with a further embodiment, the slide is movable between an open and closed position, wherein the device in the open position is configured to receive a lead wire and in the closed position is configured to form an electrical connection between the lead wire and a conductive connector.

In accordance with another embodiment the housing includes a detent configured to contact the slide for permitting a locking engagement of the housing and slide in the closed position. In accordance with a further embodiment the slide includes a locking element including a detent engaging surface and a pressure receiving surface.

In accordance with a further embodiment the housing includes a third opening formed in a third side configured to receive a disconnecting tool. The slide includes a disconnecting tool guide which may be substantially axially aligned with the third opening.

In other embodiments the slide is configured to move in the channel of the housing in a direction substantially parallel with the orientation of a conductive connector fixed substantially perpendicular to a PCB to which a bottom surface of the housing is fixed, and wherein the slide is configured to move in a direction substantially perpendicular to an inserted lead wire. As used herein, the phrases "substantially parallel" and "substantially perpendicular" mean and include true parallel and perpendicular, as well as variations therefrom which do not affect the function of the elements. One of ordinary skill in the art will recognize that electrical connection may be established using the presently disclosed subject matter in arrangements and configurations that vary somewhat from true parallel and perpendicular.

The bottom surface of the housing may be the second opening of the housing configured to receive a conductive connector extending from a PCB. The housing may include a top surface configured to receive indicia in some embodiments.

In a further embodiment the device may further include a lever hingedly extending from the housing and extending over a top surface of the slide.

In still a further embodiment, a screwless terminal block and insulation displacement connector system for a printed circuit board (PCB) includes a conductive connector extending from a PCB, a housing fixed to the PCB and having a channel and a slide slidably engaged in the channel, the slide operable to move in the channel, the housing including a first opening formed in a first side thereof configured to receive a lead wire and a second opening formed in a second side thereof housing the conductive connector extending from the PCB, the slide including a lead wire guide configured to be aligned with the opening formed in the first side of the housing, the slide further including a connector slot in which the conductive connector is positioned, wherein the conductive connector includes a lead wire receiving opening configured to be aligned with the lead wire guide and the first opening of the housing, wherein movement of the slide from a position distal the PCB toward the PCB is operable to move a lead wire positioned in the lead wire guide and the lead wire receiving opening of the conductive connector toward the PCB to form an electrical connection between the lead wire and the conductive connector. The slide may be reciprocally movable in the channel. In one embodiment the lead wire guide is configured to be substantially axially aligned with the opening formed in the first side of the housing and the conductive connector lead wire receiving opening.

The slide in the system may be movable between an open and closed position, wherein the slide in the open position is configured to receive a lead wire and in the closed position is configured to form an electrical connection between the lead wire and a conductive connector. The housing may include a detent configured to contact the slide for permitting a locking engagement of the housing and slide in the closed position. The slide may include a locking element including a detent engaging surface and a pressure receiving surface. The housing of the system may include a third opening formed in a third side configured to receive a disconnecting tool. The slide may include a disconnecting tool guide aligned with the third opening. In one embodiment the disconnecting tool guide is configured to be substantially axially aligned with the third opening, "substantially axially aligned" meaning that the alignment of the openings of the elements is adequate for a disconnecting tool to be inserted through the third opening and into the disconnecting tool guide to effect disconnection.

In one embodiment of the system, the slide is configured to move in the channel of the housing in a direction substantially parallel with the orientation of the conductive connector which is fixed substantially perpendicular to the PCB, and configured to move in a direction substantially perpendicular to an inserted lead wire.

The conductive connector includes cutting edges positioned on at least a portion of the interior edge of the lead wire receiving opening and a connector groove configured to receive lead wire conductor to form an electrical connection therewith.

The system may further include a lever hingedly extending from the housing and extending over a top surface of the slide.

Up to a certain size of lead wire, the force needed to actuate the slide, which causes the insulation to be penetrated, is low enough that ordinary finger pressure can accomplish the task. But when the size of wire requires more force, than can be comfortably applied with a finger, a tool such as a handled probe pressed onto the top of the slide can more comfortably make the connection. Alternatively, a connection force may be applied automatically with powered actuation by a press machine or the like. In accordance with a further embodiment, a terminal block includes a lever which amplifies the applied force enabling manual connection.

This design enables easy automatic wire handling, which can be digitally programmed to apply wires as required for the application. It also allows terminal blocks to be prewired automatically, which is useful for high volume devices, with fixed and predetermined circuits.

In fixed high volume predetermined circuits, any jumping between two or more positions will be done in the printed circuit, not at the terminal block.

Those skilled in the art will recognize that it is preferable to make sure that the area the terminal block occupies, at the terminal block side of the PCB, is completely free of any printed circuit traces.

Given above is a simplified summary in order to provide a basic understanding of some aspects described herein. This summary is not an extensive overview, and is not intended to identify key/critical elements or to delineate the scope of the claimed subject matter.

BRIEF DESCRIPTION OF THE DRAWINGS

So that those having ordinary skill in the art will have a better understanding of how to make and use the disclosed systems and methods, reference is made to the accompanying figure wherein.

DETAILED DESCRIPTION OF THE INVENTION

The following is a detailed description of the invention provided to aid those skilled in the art in practicing the present invention. Those of ordinary skill in the art may make modifications and variations in the embodiments described herein without departing from the spirit or scope of the present invention. Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. All publications, patent applications, patents, figures and other references mentioned herein are expressly incorporated by reference in their entirety.

Figure 1:
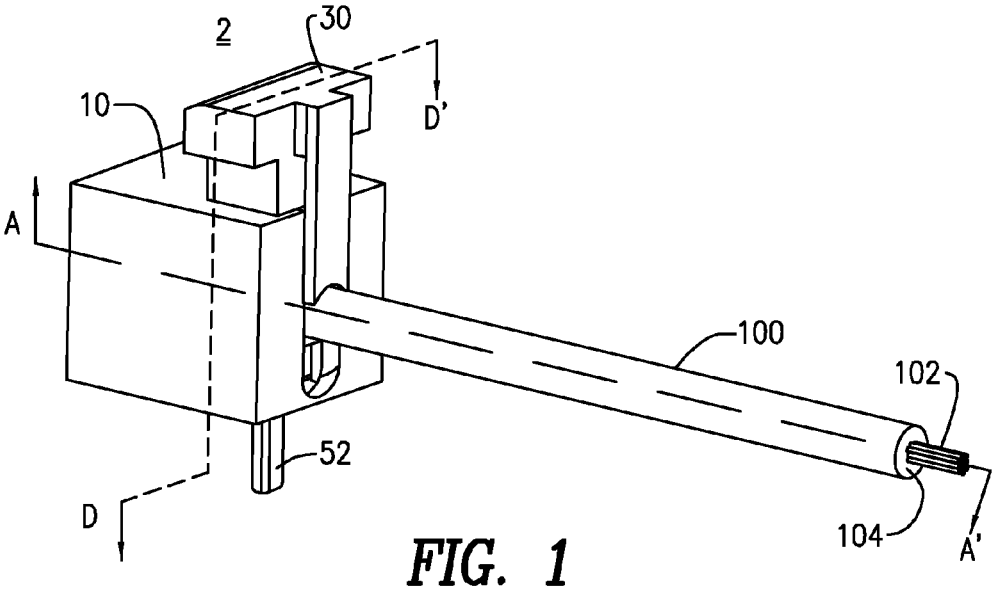
FIG. 1 is a perspective view of a screwless terminal block and insulation displacement connector device in an open position with a lead wire inserted according to one embodiment of the disclosed subject matter.
Figure 1A:
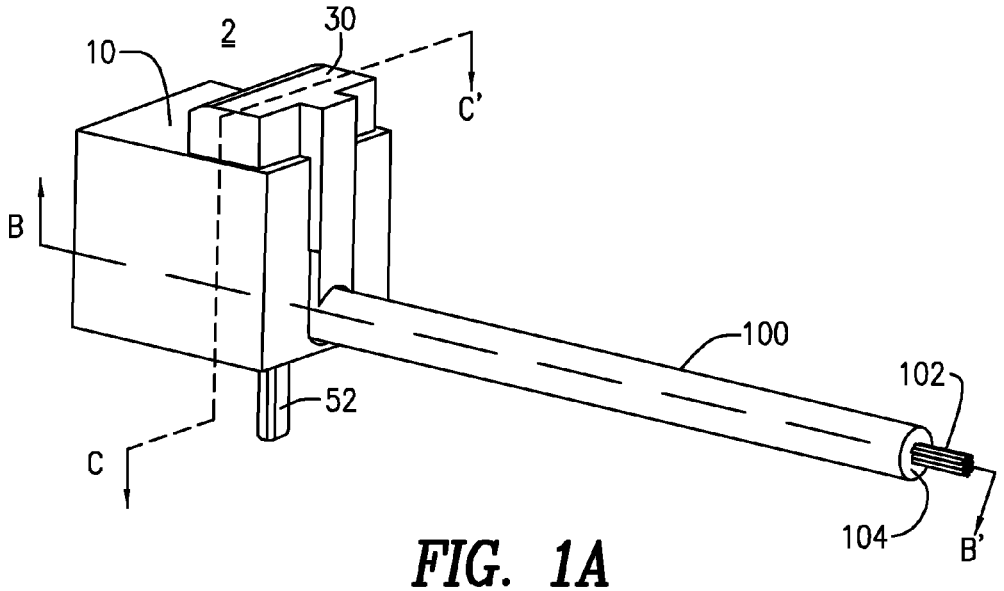
FIG. 1A is a perspective view of a screwless terminal block and insulation displacement connector device according to FIG. 1 in a closed position with a lead wire inserted according to one embodiment of the disclosed subject matter.

Now referring to FIG. 1, a screwless terminal block and insulation displacement connector device 2 includes a housing 10 and slide 30 slidably engaged in housing 10 operable to receive a lead wire 100 having lead wire conductors 102 and insulation layer 104, and to further receive a conductive connector extending from connector post 52. FIG. 1 depicts the device 2 in an open position, i.e., the slide 30 is positioned in a raised state. Now referring to FIG. 1A, the device is shown in a closed position, i.e., the slide is positioned in a lowered state.

Figure 2:
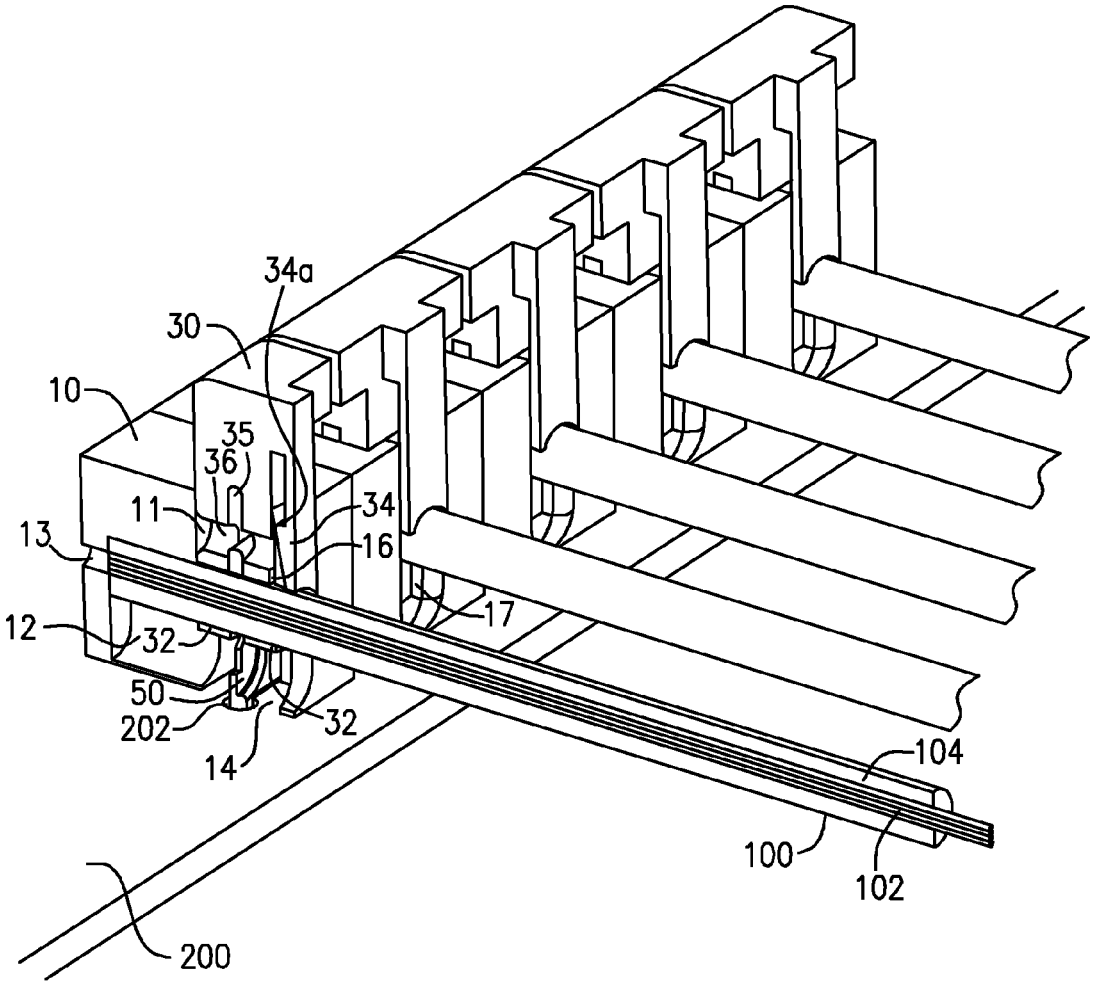
FIG. 2 is a perspective view of plural screwless terminal blocks and insulation displacement connector devices, with a cross sectional view of the terminal block of FIG. 1 taken along line A-A' in accordance with one embodiment of the disclosed subject matter.
Figure 2A:
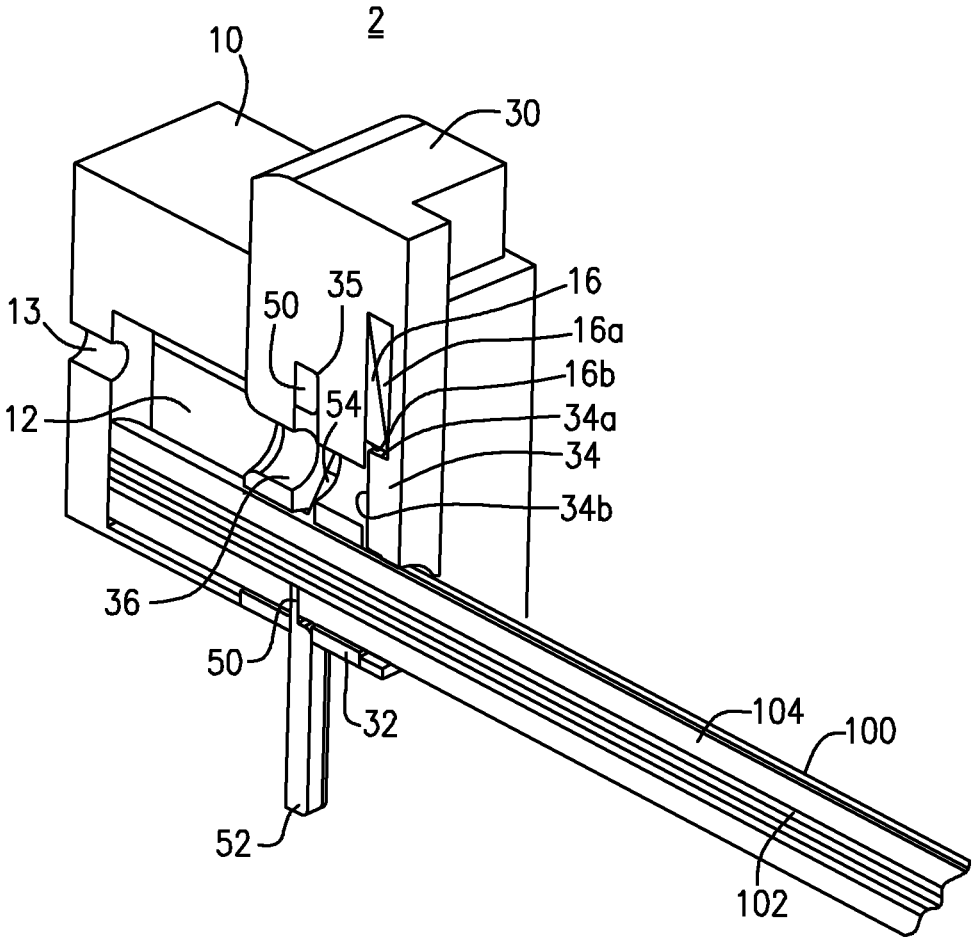
FIG. 2A is a cross-sectional view of the terminal block and insulation displacement connector device of FIG. 1A taken along line B-B' in accordance with one embodiment of the disclosed subject matter.
Figure 4:
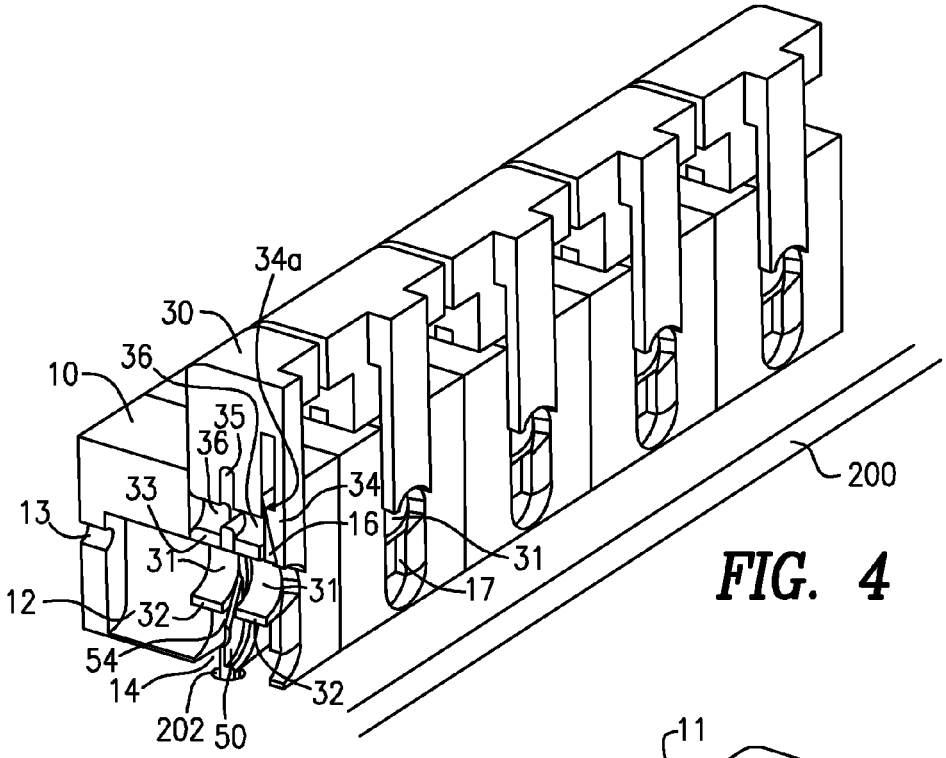
FIG. 4 is a perspective view of plural screwless terminal blocks and insulation displacement connectors, with a cross sectional view of the terminal block of FIG. 1 taken along line A-A', with the lead wire removed, in accordance with one embodiment of the disclosed subject matter.

Now referring to FIG. 2, in one embodiment device 2 is shown positioned on a PCB 200 having an aperture 202 in which a connector 50 is situated. Housing 10 includes a channel 11 operable to slidably engage slide 30, cavity 12, aperture 13 for receiving a disconnector tool (not shown), bottom opening 14 to receive connector 50 and lead wire receiving opening 17 to receive a lead wire 100. Housing 10 further includes a detent 16 operable to contact slide 30 for permitting a locking engagement of the housing 10 and slide 30 in the closed position. With reference to FIG. 4, top surface 11 of housing 10 may include space for applying indicia 20 to mark connections.

Slide 30 is configured to move in channel 11 of housing 10 in a direction parallel with the orientation of a connector 50, and perpendicular to an inserted lead wire 100. With further reference to FIGS. 2A, 4, 4A and 5, slide 30 includes lead wire guide 31, lead wire guide upper surfaces 33, feet 32, locking element 34 having a detent engaging surface 34*a* and pressure receiving surface 34*b*, connector receiving slot 35, and disconnecting tool guide 36. Locking element 34 may be fixed at one end to an upper portion of slide 30 and free at an opposing end so that it may be biased during movement of the slide 30 from an open to a closed position, and released from detent 16. Those having ordinary skill in the art will recognize that the elements forming the locking engagement between the housing and slide may take other forms.

Lead wire guide 31 is essentially a bore formed in opposing walls 37 of slide 30. Connector receiving slot 35 is formed between opposing walls 37.

Figure 3:
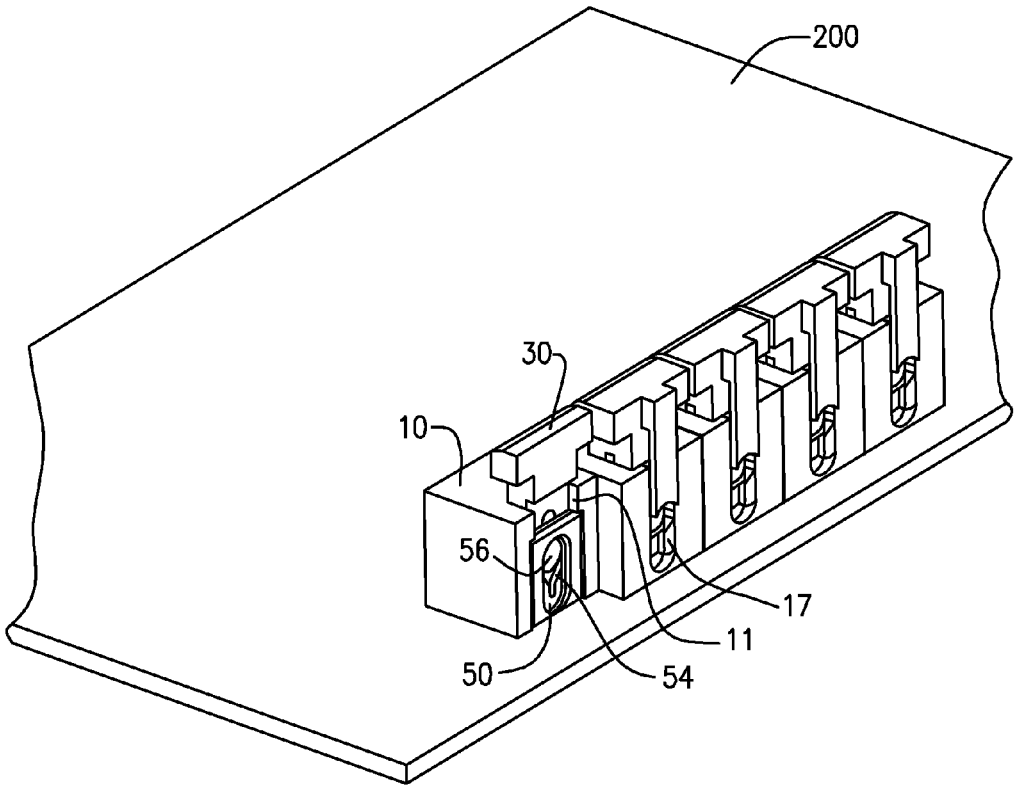
FIG. 3 is a perspective view of plural screwless terminal blocks and insulation displacement connectors, with a cross sectional view of the terminal block and insulation displacement connector device of FIG. 1 taken along line D-D' in accordance with one embodiment of the disclosed subject matter.
Figure 3A:
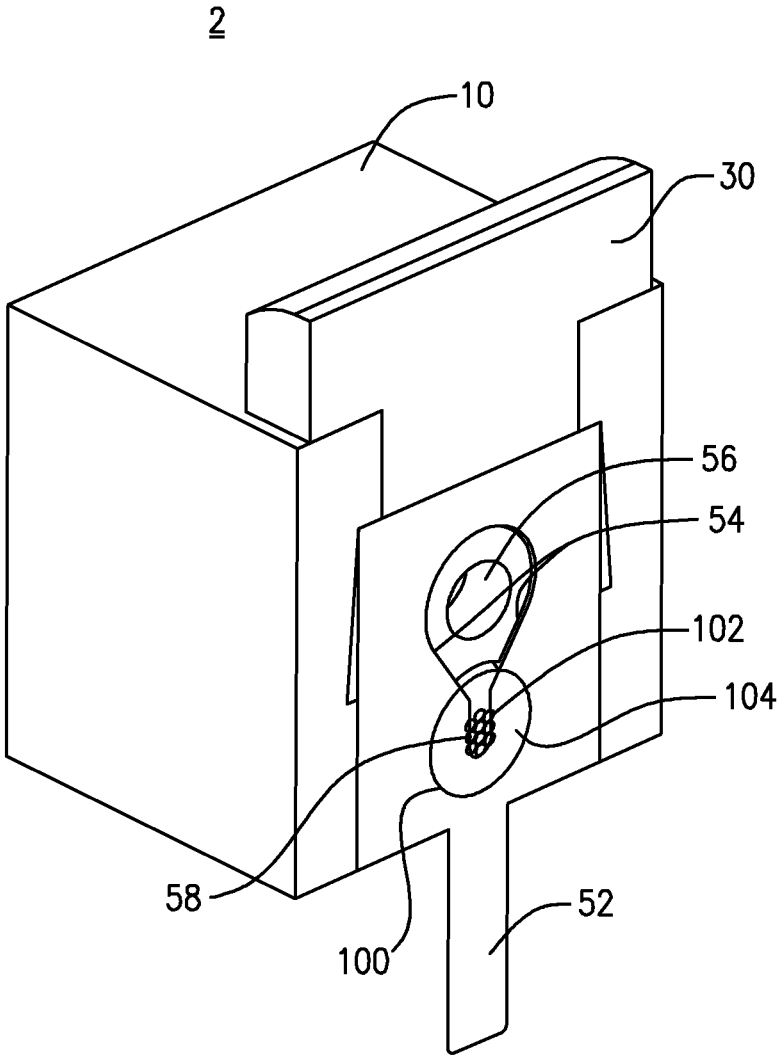
FIG. 3A is a cross-sectional view of the terminal block and insulation displacement connector device of FIG. 1A taken along line C-C' in accordance with one embodiment of the disclosed subject matter.
Figure 5:
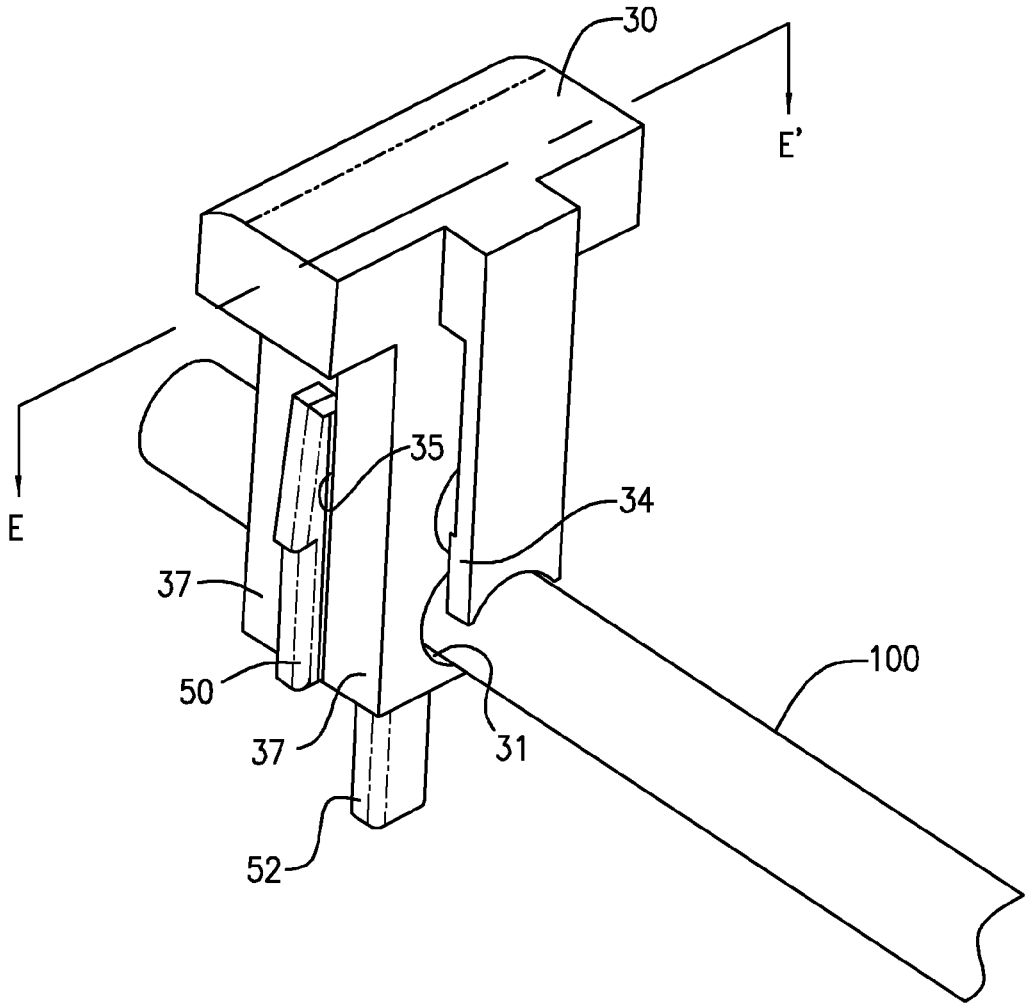
FIG. 5 is a perspective view of detail of a slide of the terminal block and insulation displacement connector device of FIG. 2 in accordance with one embodiment of the disclosed subject matter.
Figure 5B:
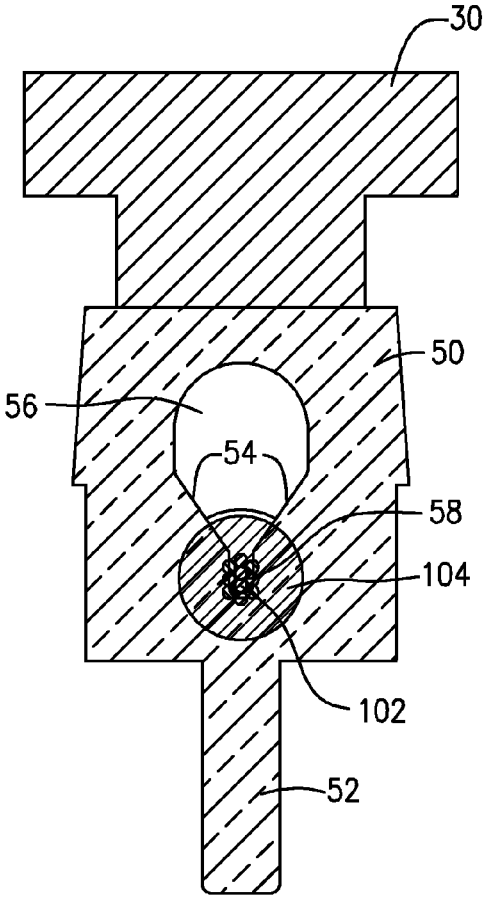
FIG. 5B is a front cross-sectional detail view of a slide engaged to a connector along the line E-E' of FIG. 5 in accordance with one embodiment of the disclosed subject matter.
Figure 5A:
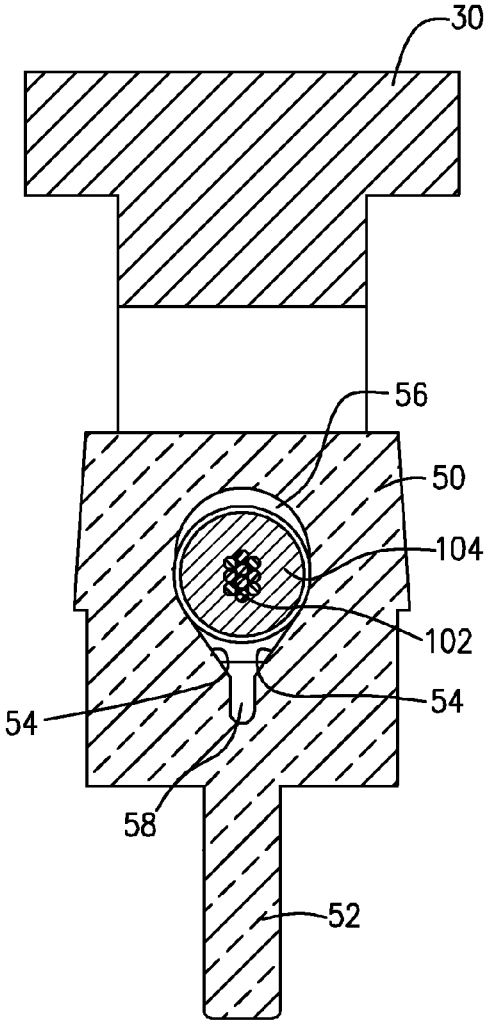
FIG. 5A is a front cross-sectional detail view of a slide engaged to a connector along the line D-D' of FIG. 1 in accordance with one embodiment of the disclosed subject matter.
Figure 6:
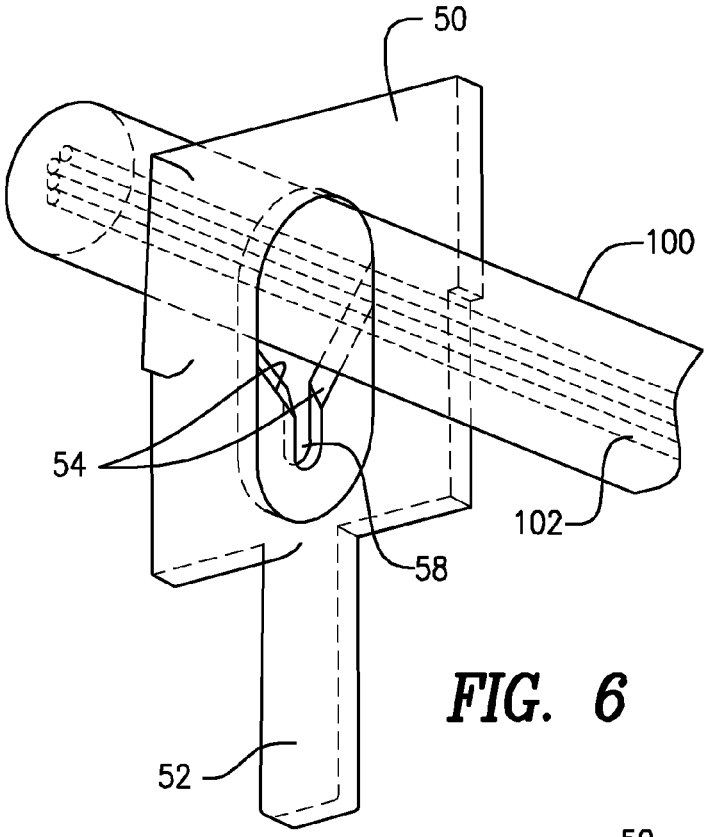
FIG. 6 is a perspective view of a connector and lead wire prior to electrical connection in accordance with one embodiment of the disclosed subject matter.
Figure 6A:
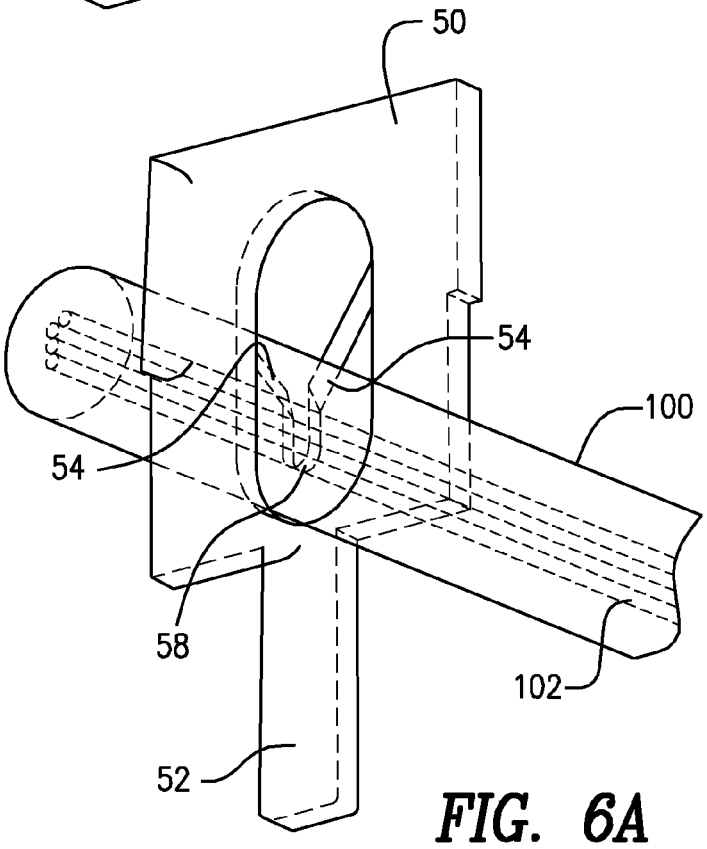
FIG. 6A is a perspective view of a connector and lead wire after electrical connection in accordance with one embodiment of the disclosed subject matter.

Housing 10 and slide 30 are constructed of non-conductive material. Connector 50 is made of conductive material. Housing 10 may be fixed on a PCB by any means known in the art. In one embodiment, housing 10 is positioned on a PCB such that a connector 50, which may be soldered to PCB, is positioned upright and within bottom opening 14 and in parallel alignment with connector receiving slot 35 of slide 30. With further reference to FIGS. 3, 4 and 5A, a lead wire receiving opening 56 in connector 50 is substantially axially aligned with lead wire guide 31 of slide 30 when the device 2 is in the open position. Connector 50 is positioned between feet 32 of slide 30 when the device 2 is in the open position. The connector 50 may include one or more insulation cutting blades 54 and a lead wire receiving opening 56 for receiving a lead wire 100, and a connector groove 58.

When the device 2 is in the open position, lead wire receiving opening 17 of housing 10, lead wire guide 31, and lead wire receiving opening 56 of connector 50, are positioned in substantial axial alignment to receive a lead wire. Lead wire 100 may thus be inserted in through lead wire receiving opening 17 and easily and properly seated in position to form an electrical connection with connector 50 when the slide 30 is moved to the closed position.

Movement of the slide 30 from an open to a closed position causes locking element 34 of slide 30 to open as it moves along ramp surface 16*a* of detent 16, and close to engage detent engagement surface 16*b*.

With reference to FIGS. 2A, 3A, 5B, 6 and 6A, when the slide 30 is moved to a closed position with a lead wire 100 inserted in device 2, lead wire 100 is urged downward to contact connector edges 54, which, with continued downward force, cut insulation layer 104. Continued downward force, to full closure of the device 2, forces lead wire conductors 102 into connector groove 58 in compressed multiple electrical contact with the connector 50.

Figure 4A:
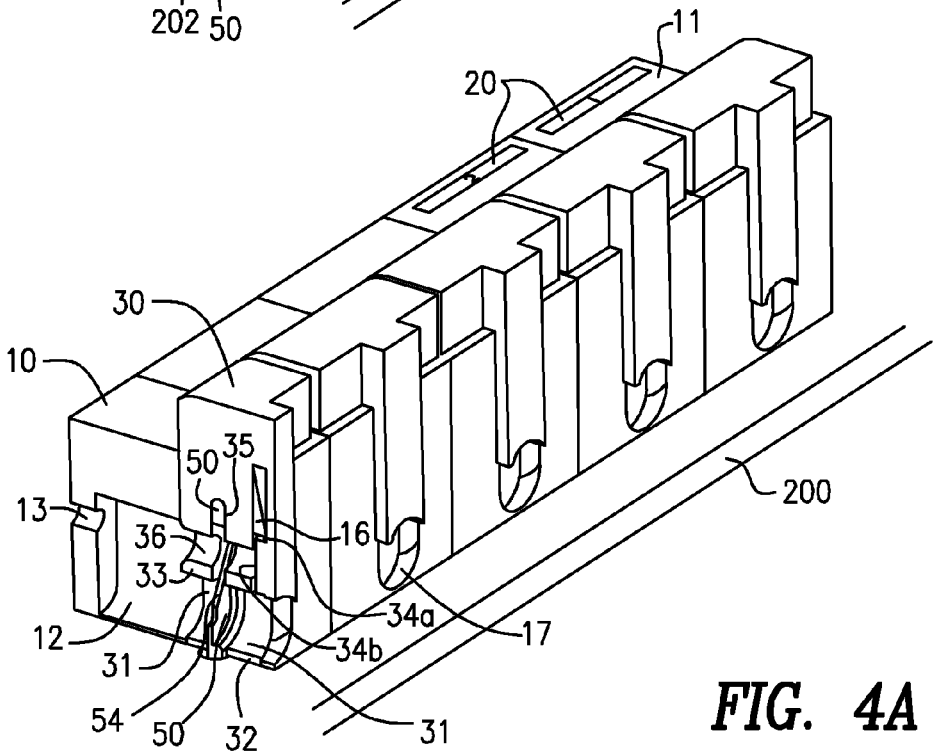
FIG. 4A is a perspective view of plural screwless terminal blocks and insulation displacement connectors, with a cross sectional view of the terminal block and insulation displacement connector device of FIG. 1A taken along line B-B', with the lead wire removed, in accordance with one embodiment of the disclosed subject matter.

With further reference to FIG. 4A, when the device 2 is in a closed position, feet 32 are seated in bottom opening 14 of housing 10 and disconnecting tool guides 36 are substantially axially aligned with aperture 13. Detent 16 engages detent engaging surface 34*a* of locking element 34 and pressure receiving surface 34*b* is positioned to receive pressure from a disconnecting tool. Pressure on surface 34*b* from a disconnecting tool fed through aperture 13 of housing 10 is operable to release detent engaging surface 34*a* from detent 16. Disconnecting tool may be any suitable tool such as a pin. Preferably the disconnecting tool is nonconductive.

Manual pressure on a top surface of the slide 30 may be adequate to close the device 2 on a lead wire 100. However, in some cases further pressure may be required.

Figure 7:
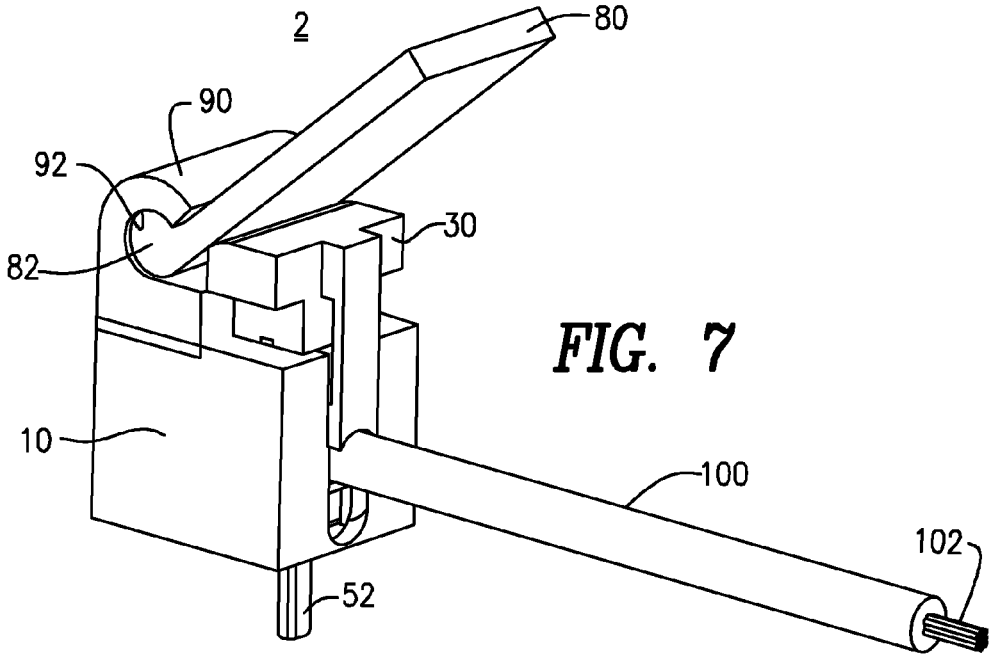
FIG. 7 is a perspective view of an alternate embodiment of a screwless terminal block and insulation displacement connector device in an open position with a lead wire inserted according to one embodiment of the disclosed subject matter.
Figure 7A:
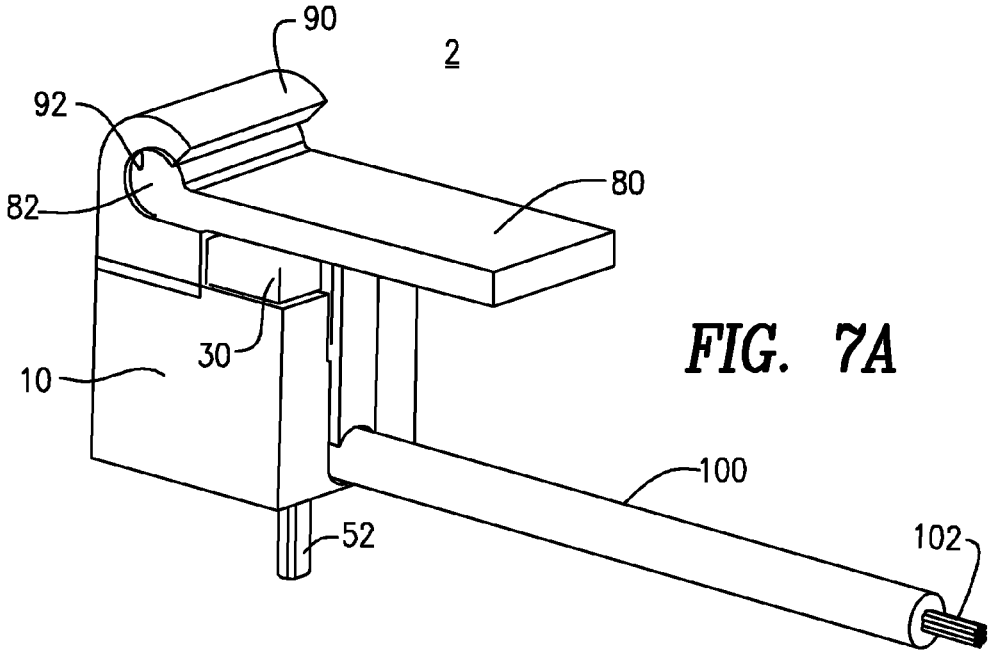
FIG. 7A is a perspective view of an alternate embodiment of a screwless terminal block and insulation displacement connector device in a closed position with a lead wire inserted according to one embodiment of the disclosed subject matter.

Now referring to FIGS. 7 and 7A, in another embodiment, device 2 may include a lever 80 engaged at end 82 to a hinge 90 via channel 92 extending from housing 10. Downward pressure of the lever 80 provides force on slide 30 to close device 2. Hinge 90 may be a rotatable hinge, living hinge or the like.

Advantages of the embodiments herein include fast, five second (or less) installation for each lead wire, easy non-stripping preparation of lead wires, no tools necessary for initial connection, no power tool vibration, connection labels are visible, and cost competitive. Additional advantages included are that although in one embodiment the connection created may be permanent, lead wires can be disconnected. Additionally, lead wires double retained, the devices are fully insulated, there is no exposed live metal, except solder probes, and the connector can connect to a variety of sizes and insulation types.

Although the systems and methods of the present disclosure have been described with reference to exemplary embodiments thereof, the present disclosure is not limited thereby. Indeed, the exemplary embodiments are implementations of the disclosed systems and methods are provided for illustrative and non-limitative purposes. Changes, modifications, enhancements and/or refinements to the disclosed systems and methods may be made without departing from the spirit or scope of the present disclosure. Accordingly, such changes, modifications, enhancements and/or refinements are encompassed within the scope of the present invention.

What is claimed is:

1. A screwless terminal block and insulation displacement connector device for a printed circuit board (PCB) comprising a housing having a channel and a slide slidably engaged in the channel, the slide operable to move in the channel between an open and closed position, the housing comprising a first opening formed in a first side thereof configured to receive a lead wire, a second opening formed in a second side thereof configured to receive a conductive connector extending from a PCB, a detent configured to contact the slide for permitting a locking engagement of the housing and slide in the closed position, and a third opening formed in a third side configured to receive a disconnecting tool, the slide comprising a locking element comprising a detent engaging surface and a pressure receiving surface, a disconnecting tool guide substantially axially aligned with the third opening and a lead wire guide configured to be substantially axially aligned with the opening formed in the first side of the housing, the slide further comprising a connector slot configured to receive a conductive connector receivable in the second opening of the housing, wherein the conductive connector comprises a lead wire receiving opening configured to be substantially axially aligned with the lead wire guide and the first opening of the housing, wherein the device in the open position is configured to receive a lead wire and in the closed position is configured to form an electrical connection between the lead wire and a conductive connector, wherein movement of the slide from a position distal the PCB toward the PCB is operable to move a lead wire positioned in the lead wire guide and the lead wire receiving opening of the conductive connector toward the PCB to form an electrical connection between the lead wire and the conductive connector.

2. The screwless terminal block and insulation displacement connector device according to claim 1 wherein the slide is configured to move in the channel of the housing in a direction substantially parallel with the orientation of a conductive connector fixed substantially perpendicular to a PCB to which a bottom surface of the housing is fixed, and wherein the slide is configured to move in a direction substantially perpendicular to an inserted lead wire.

3. The screwless terminal block and insulation displacement connector device according to claim 2 wherein the bottom surface of the housing comprises the second opening of the housing configured to receive a conductive connector extending from a PCB.

4. The screwless terminal block and insulation displacement connector device according to claim 1 wherein the housing comprises a top surface configured to receive indicia.

5. The screwless terminal block and insulation displacement connector device according to claim 1 further comprising a lever hingedly extending from the housing and extending over a top surface of the slide.

6. A screwless terminal block and insulation displacement connector system for a printed circuit board (PCB) comprising a conductive connector extending from a PCB, a housing fixed to the PCB and having a channel and a slide slidably engaged in the channel and, operable to move in the channel between an open and closed position, the housing comprising a first opening formed in a first side thereof configured to receive a lead wire, a second opening formed in a second side thereof housing the conductive connector extending from the PCB, a detent configured to contact position, and a third opening formed in a third side configured to receive a disconnecting tool, the slide comprising a locking element comprising a detent engaging surface and a pressure receiving surface, a disconnecting tool guide substantially axially aligned with the third opening and a lead wire guide configured to be substantially axially aligned with the opening formed in the first side of the housing, the slide further comprising a connector slot in which the conductive connector is positioned, wherein the conductive connector comprises a lead wire receiving opening configured to be substantially axially aligned with the lead wire guide and the first opening of the housing, wherein the device in the open position is configured to receive a lead wire and in the closed position is configured to form an electrical connection between the lead wire and a conductive connector, wherein movement of the slide from a position distal the PCB toward the PCB is operable to move a lead wire positioned in the lead wire guide and the lead wire receiving opening of the conductive connector toward the PCB to form an electrical connection between the lead wire and the conductive connector.

7. The system according to claim 6 wherein the slide is configured to move in the channel of the housing in a direction substantially parallel with the orientation of the conductive connector which is fixed substantially perpendicular to the PCB, and wherein the slide is configured to move in a direction substantially perpendicular to an inserted lead wire.

8. The system according to claim 6 wherein the conductive connector comprises cutting edges positioned on at least a portion of the interior edge of the lead wire receiving opening and a connector groove configured to receive lead wire conductor to form an electrical connection therewith.

9. The system according to claim 6 further comprising a lever hingedly extending from the housing and extending over a top surface of the slide.

* * * * *

UNITED STATES PATENT AND TRADEMARK OFFICE

CERTIFICATE OF CORRECTION

PATENT NO. : 9,184,515 B1
APPLICATION NO. : 14/039636
DATED : November 10, 2015
INVENTOR(S) : Anthony Freakes It is certified that error appears in the above-identified patent and that said Letters Patent is hereby corrected as shown below:

In The Claims

Claim 6, Column 10, line 1, after the word "contact" and before the word "position" insert the words --the slide for permitting a locking engagement of the housing and slide in the closed--

Signed and Sealed this
Fifth Day of April, 2016

Michelle K. Lee

Michelle K. Lee
*Director of the United States Patent and Trademark Office*